US006978967B1

(12) United States Patent
Scheper et al.

(10) Patent No.: US 6,978,967 B1
(45) Date of Patent: Dec. 27, 2005

(54) SPACE SAVING FIN DEPLOYMENT SYSTEM FOR MUNITIONS AND MISSILES

(75) Inventors: Eric Scheper, Essex Fells, NJ (US); Anthony Vella, East Hanover, NJ (US); Dave Maurizi, Fairfax, VA (US); Andrew Molina, Stroudsburg, PA (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 10 days.

(21) Appl. No.: 10/709,180

(22) Filed: Apr. 20, 2004

Related U.S. Application Data

(60) Provisional application No. 60/320,144, filed on Apr. 25, 2003.

(51) Int. Cl.[7] ..... F42B 10/00
(52) U.S. Cl. ..... 244/3.24; 244/3.27; 102/385
(58) Field of Search ..... 244/3.23, 3.24, 244/3.29, 3.3, 3.27; 102/385

(56) References Cited

U.S. PATENT DOCUMENTS

| | | | | |
|---|---|---|---|---|
| 2,941,470 | A * | 6/1960 | Jasse | 244/3.23 |
| 3,085,511 | A * | 4/1963 | Donner | 244/3.24 |
| 3,238,875 | A * | 3/1966 | Stadler et al. | 244/3.24 |
| 3,695,556 | A * | 10/1972 | Gauzza et al. | 244/3.29 |
| 3,952,662 | A * | 4/1976 | Greenlees | |
| H905 | H * | 4/1991 | Rottenberg | |
| 6,234,082 | B1 * | 5/2001 | Cros et al. | |
| 6,571,715 | B1 * | 6/2003 | Bennett et al. | 244/3.27 |
| 6,672,536 | B2 * | 1/2004 | Bar et al. | 244/3.27 |
| 6,748,871 | B2 * | 6/2004 | Hellman | 244/3.27 |
| 6,779,754 | B2 * | 8/2004 | Hellman | 244/3.27 |
| 2004/0200375 | A1 * | 10/2004 | Kautzsch et al. | |

* cited by examiner

*Primary Examiner*—J. Woodrow Eldred
(74) *Attorney, Agent, or Firm*—Michael C. Sachs; John F. Moran

(57) ABSTRACT

A fin deployment system for missiles and munitions that deploys and activates straight flat fins for roll control authority. The fin deployment system employs numerous design features, among which are the following: A wrap-around fin concept generates space-savings within a projectile body whereby the fins are arranged in a wrapped configuration around a boomtail structure. The fins may be constructed of a super-elastic material; the system eliminates mechanical means of deploying the wrapped fins, eliminating the need for springs to deploy the fins. The fin deployment achieves substantial space savings for increasing the onboard towing capacity of electronic packaging or lethality in the missiles and munitions systems, while at the same time providing a good roll control authority during flight by enabling a straight fin deployment resulting from the use of super-elastic materials.

3 Claims, 10 Drawing Sheets

SPACE SAVING FIN DEPLOYMENT SYSTEM FOR MUNITIONS AND MISSILES

CROSS REFERENCE TO RELATED APPLICATIONS

This application claims benefit under 35 USC 199(e) of provisional application 60/320,144, filed Apr. 25, 2003, the entire file wrapper contents of which provisional application are herein incorporated by reference as though fully set forth at length.

FEDERAL RESEARCH STATEMENT

The inventions described herein may be manufactured, used and licensed by or for the U.S. Government for U.S. Government purposes.

BACKGROUND OF INVENTION

1. Field of the Invention

The present invention relates in general to the field of Missiles and Munitions used by the Armed Forces, and it particularly relates to a new design method for a fin deployment system that enables a substantial reduction in the volume of munitions as compared to those employing conventional fin deployment systems. More specifically, the present invention incorporates a novel wrap-around fin concept that is capable of achieving a straight fin deployment which is necessary in maintaining a proper roll control authority during flight while substantially reducing the volume, hence weight, of missiles and munitions. The volume reduction thus translates into significant tactical advantages of these new missiles and munitions incorporating the present invention by enabling more electronic payload or lethality to be packaged into the volume savings.

2. Background of the Invention

High explosive missiles and munitions are an essential part of the arsenals of the Armed Forces. Missiles and munitions are highly complex systems generally used for deploying projectiles capable of high-speed and long-range maneuvers to deliver lethality to a target or to intercept an incoming threat. A missile projectile is normally discharged by means of a gun tube, or a missile launcher, or the like. Upon exiting a muzzle of a gun tube, the projectile gains a rapid increase in speed and altitude. At a high speed flight, the trajectory and stability of a missile projectile are actively controlled by navigation and guidance electronics to operate various control surfaces such as fins and canards.

Fins are control surfaces generally deployed in the aft of a missile projectile to provide roll stability during flight. On the other hand, canards are control surfaces typically mounted in front of a missile projectile to enhance its maneuverability. Fins are normally deployed lengthwise and with a circular symmetry with respect to the projectile body to minimize asymmetric aerodynamic loading which can adversely affect the stability of the projectile. To provide a control authority, fins are constructed with hinges to allow them to be actuated individually so as to modify the aerodynamic forces on the projectile for guidance purposes.

A conventional missile projectile typically employs a fin deployment system that is housed within the projectile body and rotated perpendicular to the projectile body axis. Upon exiting a gun muzzle, the fins are activated to open up lengthwise on the projectile body to provide the roll stability. A conventional fin deployment system occupies a significant interior volume of the projectile body. For example, the boom part of a 105 mm tank projectile, which is the portion of the projectile body containing the fin deployment system, is typically about 8 inches in length and weighs approximately 11 lbs. This represents a 25% of the total volume of the projectile body. The volume taken up by a conventional fin deployment system generally is viewed as a non-utilizable space within a projectile body that could otherwise be used for carrying additional volume of warheads or other explosive materials as well as electronics packages such as guidance and control electronics. Therefore, it is a well-known design objective to minimize the take-up volume of the fin deployment system by alternate design methodologies.

Attempts to improve a fin deployment system for missiles and munitions have been considered. One such exemplary methodology utilizes a wrap-around fin deployment system on the 2.75-inch rockets. The wrap-around fin deployment system is housed in the exterior of the projectile body with the fins folded circumferentially around a center body. In theory, this conventional design is able to reduce the take-up volume of the fin deployment system. In practice, problems with this conventional fin deployment system have been encountered whereby the deployed fins have curved surfaces upon deploying from their housing, the fin itself is shaped to the profile of the missile projectile for a semi-circular fin shape. The curved fins can significantly compromise the roll control authority of a missile projectile, which is not an issue on non guided systems. Roll control authority is needed for guided missile projectile systems; therefore the deployment system used by the 2.75 inch rocket is not viable.

Thus, it is realized that the current attempts to provide a fin deployment systems that can achieve a considerable projectile volume savings while maintaining a good roll control authority heretofore remains unfulfilled. Consequently, it is therefore recognized that a further enhancement in the design methodology for a fin deployment system is still needed to achieve the foregoing objectives. Preferably, the new design methodology would provide a space saving fin deployment system capable of deploying straight fins to maintain a good roll control authority while achieving the design objective of reducing the volume of the projectile taken up by the fin deployment system.

SUMMARY OF INVENTION

It is a feature of the present invention to provide a new design methodology for fin deployment system for missiles and munitions that substantially reduces the volume taken up by the fin deployment system within a projectile body. Further, it is a novelty of the present invention to provide a new method for deploying and activating straight flat fins for roll control authority. In summary, the new design method for a space-saving straight fin deployment system employs a number of novel design features as follows:

1. A wrap-around fin concept generates space-savings within a projectile body whereby the fins are arranged in a wrapped configuration around a boomtail structure.
2. The fins may be constructed of a super-elastic material such as Nickel Titanium or Multi functional Alloy in a preferred embodiment to enable the fins to assume straight flat surfaces upon deployment without inducing any radius of curvature during in-flight trajectories. Material selection for the fin system is missile projectile size dependent. Alternatively, the fins may be made of spring steel.

3. The system eliminates mechanical means of deploying the wrapped fins, no springs are needed to deploy the fins. Physics of system generates equal deploying fins.

The space-saving fin deployment system affords advantages over a conventional fin deployment system in achieving substantial space savings for increasing the onboard towing capacity of electronic packaging or lethality in the missiles and munitions systems, while at the same time providing a good roll control authority during flight by enabling a straight fin deployment resulting from the use of super-elastic materials. In some particular applications, the space savings could be reduced by a factor of two as compared to a conventional design.

BRIEF DESCRIPTION OF DRAWINGS

The features of the present invention and the manner of attaining them will become apparent, and the invention itself will be understood by reference to the following description and the accompanying drawings, wherein.

Similar numerals in the drawings refer to similar elements. It should be understood that the sizes of the different components in the figures might not be in exact proportion, and are shown for visual clarity and for the purpose of explanation.

DETAILED DESCRIPTION

Figure 1:
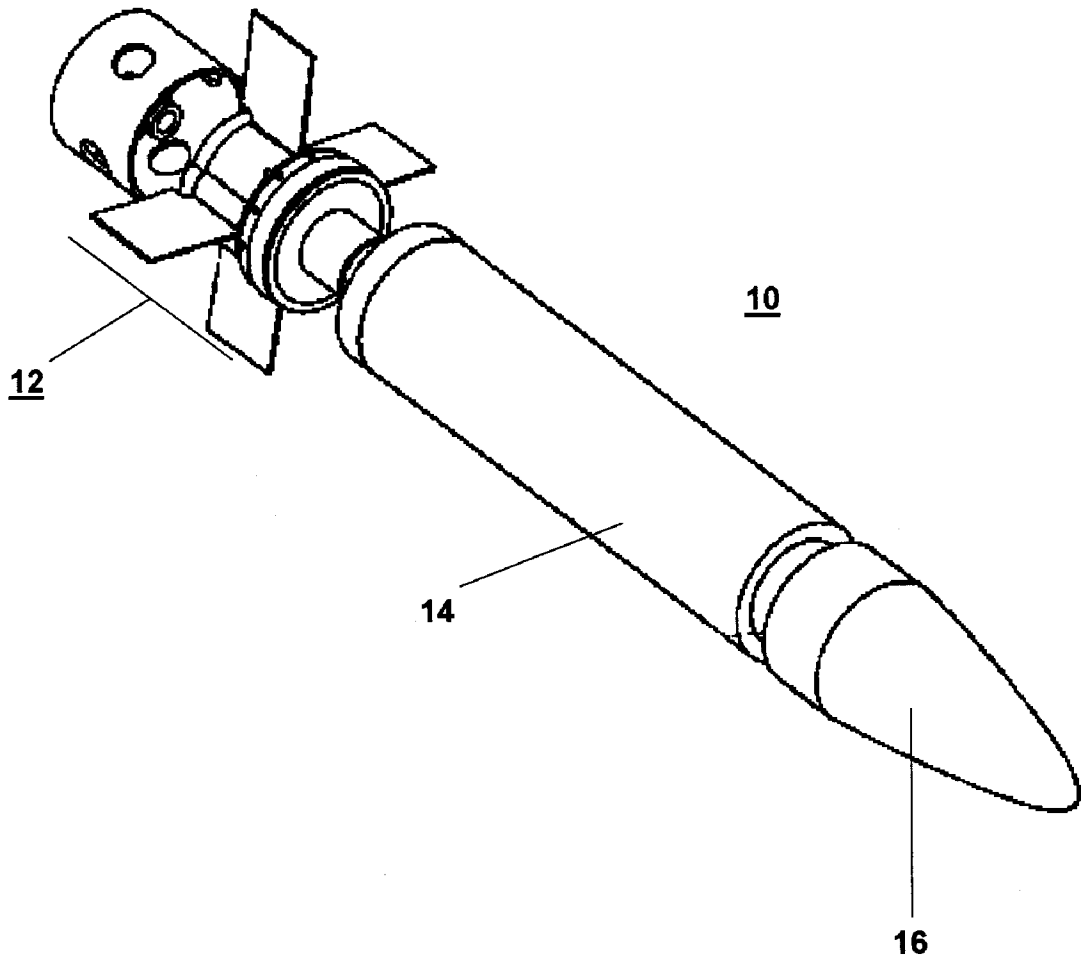
FIG. 1 is an external view of a missile or munitions system according to a smart cargo concept, shown attached to its aft end by a space-saving fin deployment system of the present invention for roll control authority.

FIG. 1 illustrates a missile or munitions system 10 incorporating a space-saving fin deployment system 12 made according to the present invention. An exemplary munitions system 10 may be based upon a smart cargo concept that includes a 105-mm tank munitions used in the U.S. Armed Forces. The munitions system 10 is generally comprised of a number of major components; namely: a projectile body 14, a nose cone 16, and a preferred embodiment of the space-saving deployment system 12 that constitutes a novelty of the present invention. Each of these major components is further described as follows:

The projectile body 14 is generally made of a thin steel shell having a cylindrical shape. The interior volume of the projectile body 14 typically contains flammable propellant charges that provide a thrust force upon ignition to propel the munitions system 10 forward during flight. In addition, the interior volume also houses electronics packages such as guidance and control or lethality component.

The nose cone 16 is generally formed of an ogive shape designed to reduce the aerodynamic drag on the munitions system 10 during flight. The nose cone 16 normally holds an explosive charge or other payload materials to destroy a target upon impact.

Figure 2:
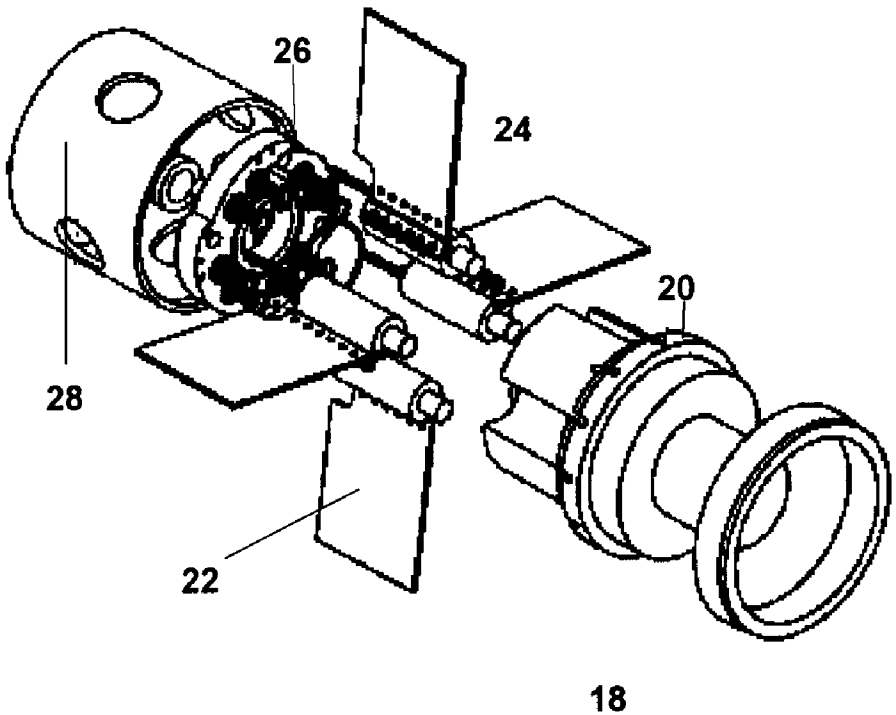
FIG. 2 is an exploded view of a preferred embodiment of the space-saving fin deployment system of FIG. 1, comprising of an obturator assembly, a cant-boomtail, a fin system, a hinge assembly, a back assembly, and a cover assembly.
Figure 3A:
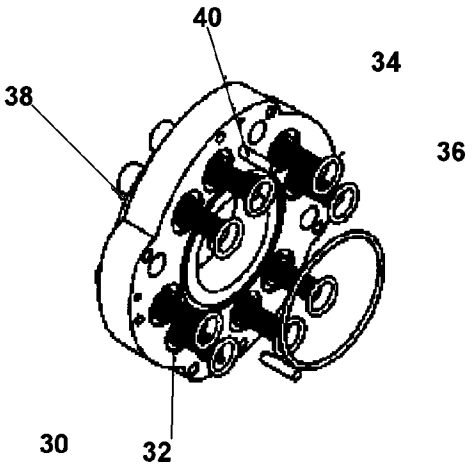
FIG. 3 illustrates various views of the back assembly of FIG. 2; comprising of a cant-back plate, a plurality of retaining bolts and O rings, and a plurality of alignment pins.

With reference to FIG. 2, the space-saving fin deployment system made in accordance with a preferred embodiment of the present invention is comprised of an obturator assembly 18, a cant boomtail 20, a fin system 22, a hinge assembly 24, a back assembly 26, and a cover assembly 28. Referring to FIG. 3A, the back assembly 26 is designed to provide a retention structure for holding the hinge assembly 24 in place. The back assembly 26 is comprised a number of components: a cant-back plate 30, a plurality of retaining bolts 32 with corresponding O-rings 34, an O-ring 36, an O-ring 38, and a plurality of alignment pins 40. In a preferred embodiment, 8 retaining bolts 32 and O-rings 34 are used to connect the cant-boomtail 20 to the back assembly 26. Further, two alignment pins 40 are used for precise positioning of the cant-boomtail 20 with respect to the back assembly 26.

Figure 3B:
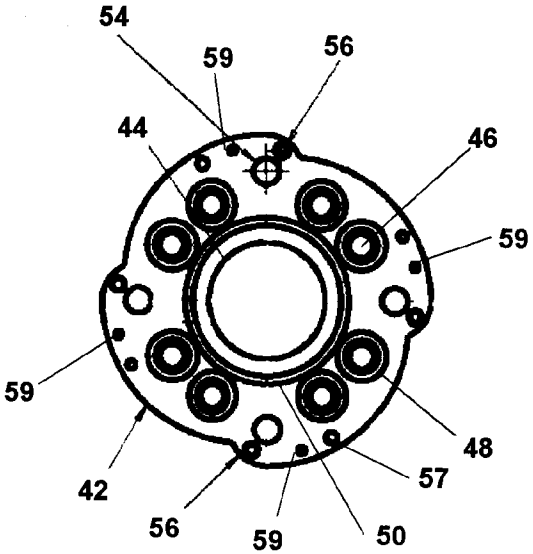

With further reference to FIG. 3B, the cant-back plate 30 is geometrically defined by a saw tooth-like cam shape 42 having a circular symmetry on the outer surface and an inner circular opening 44. According to a preferred embodiment, the cam shape is divided into four equal segments; each is formed by a quarter circular arcs with an offset radius. A plurality of pairs of bolt holes 46 are machined through the cant-back plate 30 to allow the corresponding retaining bolts 32 to be inserted through for connecting the cant-boomtail 20 with the back assembly 26. FIG. 3B illustrates four such pairs of bolt holes 46. A plurality of corresponding circular O-ring grooves 48 are present to accommodate the corresponding O-rings 34 to seal out potential gas leakage from underneath the retaining bolts 32 which may bleed into the cover assembly 28 to cause failure of the fin system 10. The placement of the O-rings ensures the generation of a forward pressure force on the cover assembly. This is needed to keep the cover assembly on during gun launch. The outside profile of the back plate mimics the shape of the boomtail.

A circular O-ring groove 50 inscribing the bolt holes 46 is designed to accommodate the O-ring 36 to seal potential gas leakage between the cant-boomtail 20 and the cant-back plate 30. Similarly, with reference to FIG. 3D, a circular O-ring groove 52 circumscribing the bolt holes 46 is present on the other side of the cant back plate 30 to receive the O-ring 38 to seal out potential gas leakage between the cover assembly 28 and the cant-back plate 30.

Figure 3C:
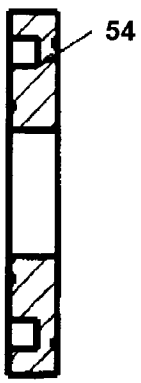
Figure 3D:
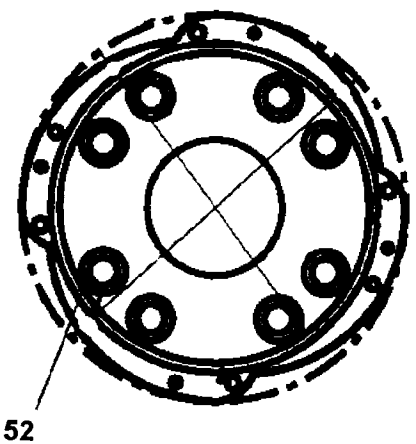

With further reference to FIGS. 3B and 3C, a plurality of small cylindrical bores 54 are formed at a partial depth through and equidistance around the periphery of the cant-back plate 30. In a preferred embodiment, there are four such cylindrical bores 54. The cylindrical bores 54 are designed to provide an engagement of the hinge assembly 24 into the back assembly 26. Moreover, a plurality of smaller pin holes 56 are machined into the cant-back plate 30 to allow the alignment pins 40 to be inserted through for precise positioning of the cant-boomtail 20 and the back assembly 26. In particular, two pin holes 56 are used according to the present invention. A plurality of threaded bolt holes 57 are also formed in the cant-back plate 30. For the present invention, two such threaded bolt holes 57 are used for attaching the back assembly 26 to the cover assembly 28. Moreover, the cant back plate 30 also includes a plurality of lock pin holes 59 for the purpose of providing a fin locking mechanism upon deployment. For a preferred embodiment, four such lock pin holes 59 are employed as shown in FIG. 3B.

Figure 4:
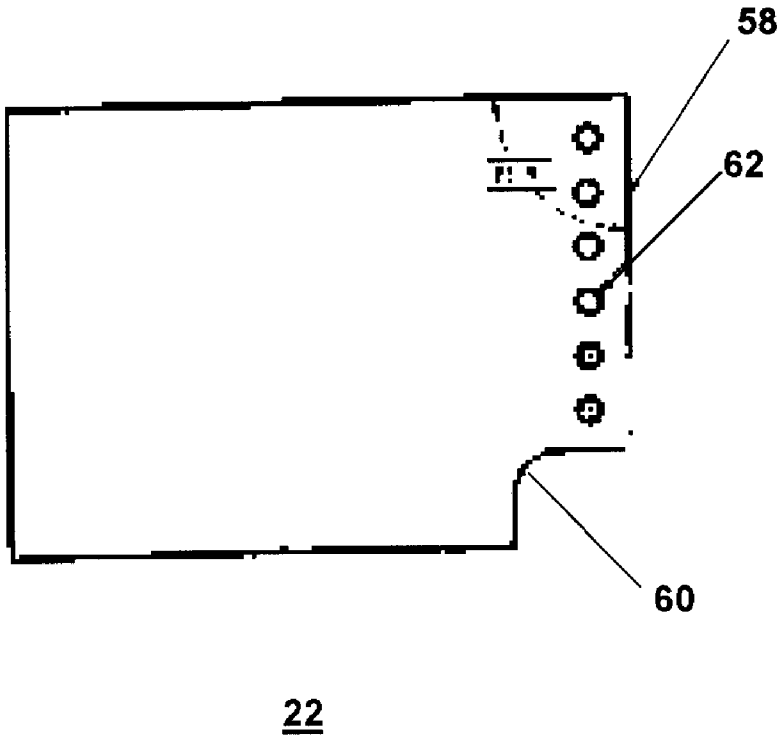
FIG. 4 illustrates the fin system of FIG. 2 made according to the present invention.

Referring now to FIGS. 2 and 4, the fin system 22 is comprised of a plurality of fins 58. According to the present invention, four such fins 58 are used in the space-saving fin deployment system 12. The shape of the fins 58 is normally determined by an aerodynamic analysis to provide the stability needed for in-flight trajectories. According to a preferred embodiment, the fins 58 generally are constructed from thin structural plates shaped in a rectangular plan form with a radius corner cutout 60. Alternatively, the shape of the fins 58 may also assume other forms as necessary.

According to a preferred embodiment, the fins 58 may be constructed from a super elastic metallic alloy of nickel titanium or a multifunctional alloy. Other materials of similar characteristics such as iron manganese silicon or even spring steel may also be used as alternate fin materials to provide a desirable radius of curvature of the fins 58 when in the stowed position. The super-elasticity of the fin material is an essential and enabling feature of the present invention in allowing the fins 58 to undergo a substantial deflection without suffering any permanent deformation resulting from the wrap-around towed position, thereby enabling the fins 58 to spring open flat upon deployment without introducing any undesirable curvature into the surfaces of the fins 58. Hence, good roll control authority of the munitions system 10 is therefore achievable.

With further reference to FIG. 4, a plurality of bolt holes 62 perforate the fins 58 on one of its sides adjoining the radius corner cutout 60. These bolt holes 62 are designed to secure the fins 58 to the hinge assembly 24 as illustrated in FIG. 5.

Figure 5:
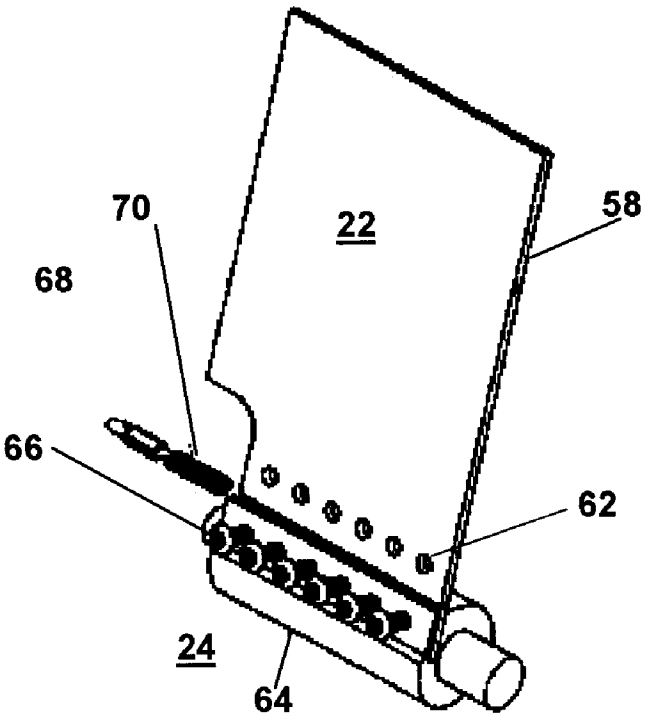
FIG. 5 illustrates an assembly view of the fin system of FIG. 4 and the hinge assembly of FIG. 2 that is comprised of a plurality of cant hinges, a plurality of retaining bolts, a plurality of lock pins, and a plurality of compression springs.

With further reference to FIG. 5, the hinge assembly 24 is comprised of a plurality of cant hinges 64, each with a plurality of retaining bolts 66, a plurality of lock pins 68, and a plurality of compression springs 70. In a preferred embodiment, four each of cant hinges 64, lock pins 68, and compressor springs 70 are employed in the space-saving fin deployment system 12. Referring now to FIG. 6A, the cant hinge 64 includes a hinge portion 72, a larger end plug 74, and a smaller end plug 76. Both the end plugs 74 and 76 have a cylindrical construction disposed at either distal end of the hinge portion 72.

Figure 6B:
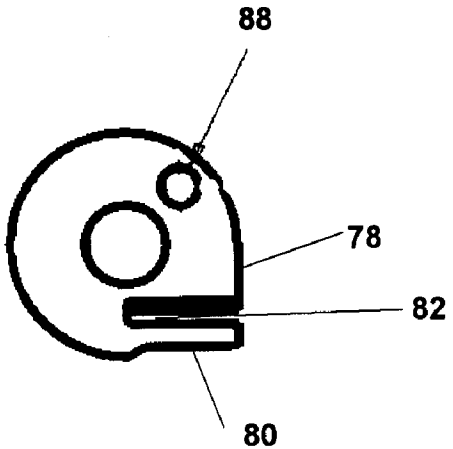
FIG. 6 illustrates various orthogonal and perspective views of the cant hinges of FIG. 5.

With reference to FIG. 6B, the hinge portion 72 is shaped is a form of a nearly circular cross section with a 270-degree circular arc tangent at either end to two flat sides 78 and 80. A straight groove 82 is machined into the hinge portion 72 to span its entire length along the flat side 80. The thickness of the groove 82 is substantially the same as the thickness of the fins 58.

Figure 6D:
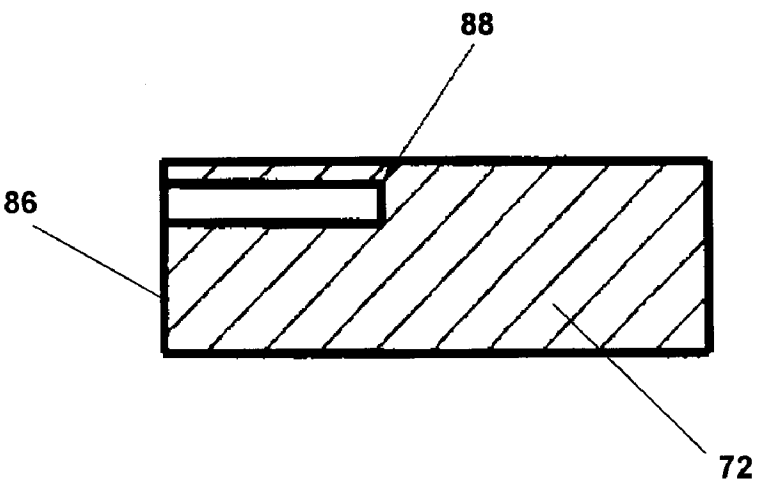
Figure 6A:
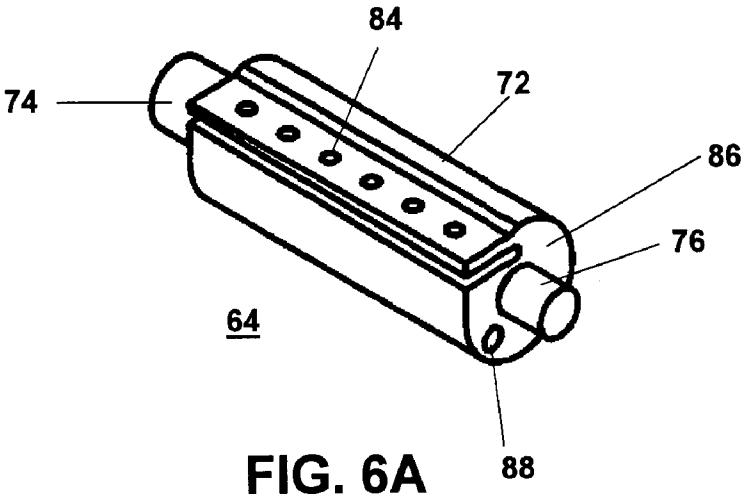
Figure 6C:
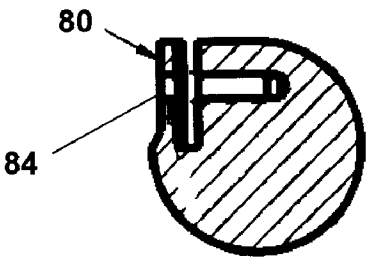

With reference to FIGS. 6A and 6C, a plurality of bolt threaded holes 84 perforate the flat side 80 and further penetrate into the hinge portion 72 with a substantial depth of thread relative to the width of the hinge portion 72 thereat. The threaded bolt holes 84 are precisely machined so as to match dimensions and positions of the bolt holes 62 of the fins 58. The bolts also act as stopping reference for hinge rotation.

With reference to FIG. 6D, on a distal end surface 86 of the hinge portion 72 whereupon the smaller end plug 76 is formed, a straight cylindrical bore 88 is constructed lengthwise at a partial depth through the hinge portion 72. The straight cylindrical bore 88 is designed to receive the lock pin 68 and the compression spring 70.

Figure 7B:
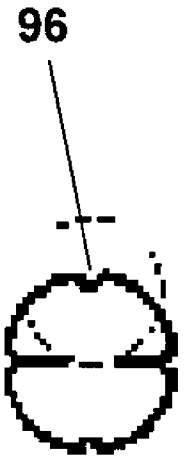
FIG. 7 illustrates an isometric and cross sectional views of the lock pins of FIG. 5.
Figure 7A:
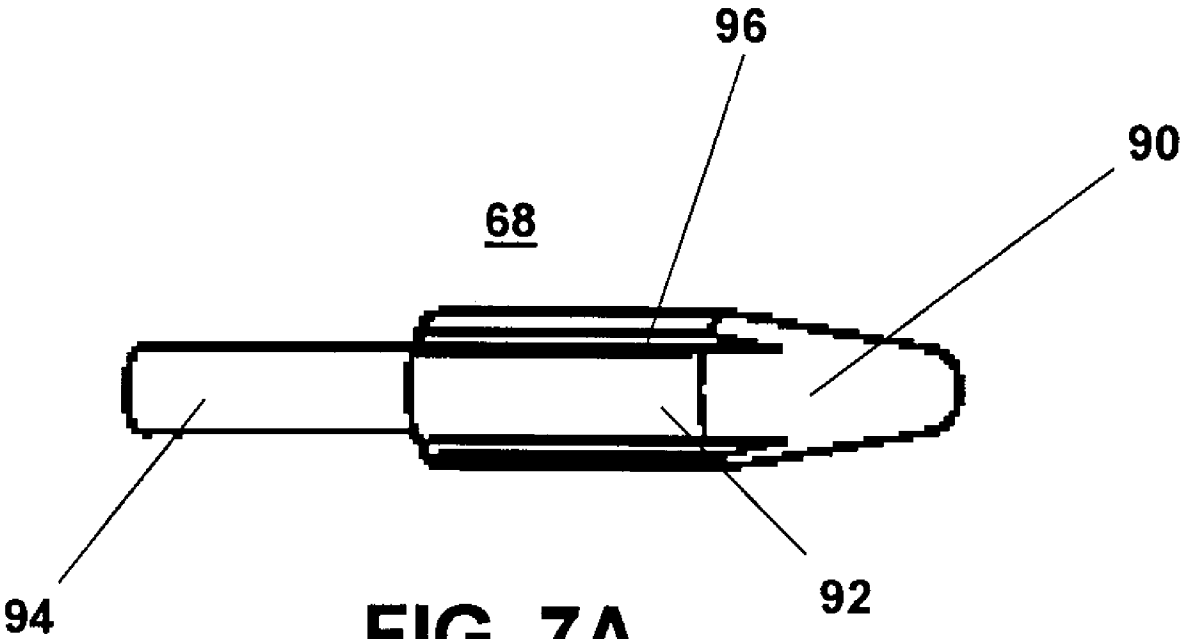

With reference to FIG. 7A, the lock pin 68 is comprised of a taper blunt nose section 90, a mid section 92, and a cylindrical aft section 94. The taper blunt nose section 90 has a conical section feature that transitions to a hemispherical nose. The taper nose allows for insertion of the pin quicker than if the pin was cylindrical. As well the taper pin wedges itself into the mating hole in the back plate to remove all machining tolerance from the system. The mid section 92 is shaped as a constant diameter section having a plurality of shallow right angle slots 96 spaced at equidistance around the periphery of the mid section 92. In particular, there are four such right angle slots 96 in a preferred embodiment. The right angle slots 96 are designed to relieve pressure from the bore of the lock pin. The lock pin 68 has a posted section that goes through the middle of the compression spring. The post protects the spring from being compressed more than it is designed to be. The lock pin 68 also is designed to have a specific wheelbase length relative to the length of the conical section to provide more stability of the pin while locked. The cylindrical aft section 94 has a smaller diameter and is designed to accept the compression spring 70 as shown in FIG. 5.

Figure 8B:
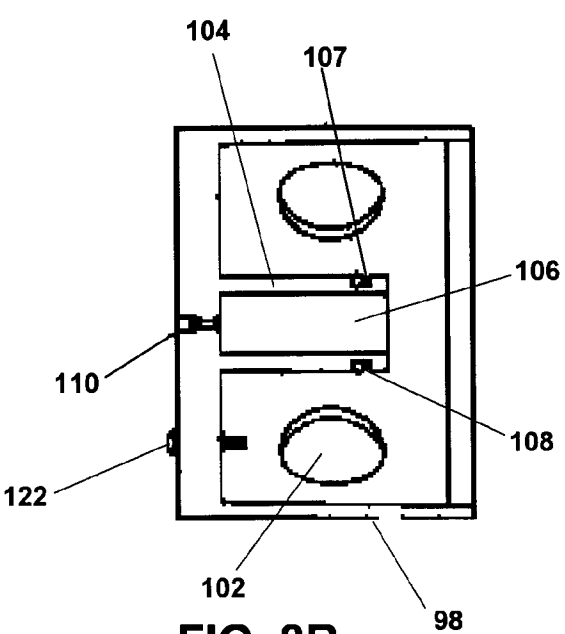
FIG. 8 illustrates various views of the cover assembly of FIG. 2.
Figure 8A:
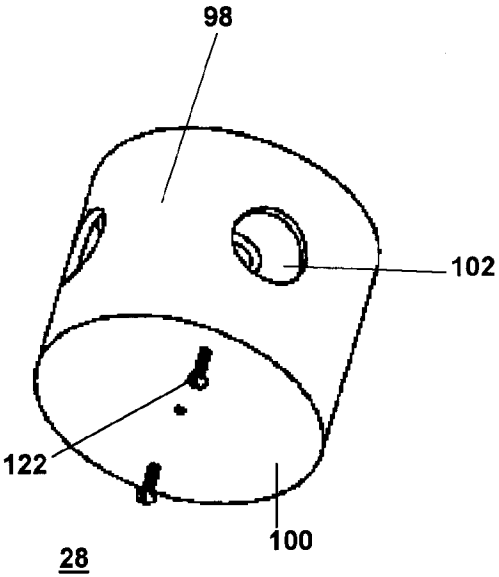

Referring now to FIG. 8A, the cover assembly 28 is shaped as a thin cylindrical cap having a cylindrical wall 98 and a circular end plate 100. The cover assembly 28 is designed to enclose the fin system 22 when in the stowed position. A plurality of circular holes 102 are formed at equidistance around the periphery of the cylindrical wall 98. In a preferred embodiment, four such circular holes 102 are employed. These circular holes 102 are designed to allow for pressure equalization around the inside ands outside of the cover, they also provide means to evacuate gas after muzzle exit. These holes are needed for structural survivability of the cover, without them the cover will collapse from gun pressure while in the gun.

With reference to FIG. 8B, a hollow cylindrical plug 104 is formed on the interior of the cover assembly and is integrally attached to the circular end plate 100. The hollow cylindrical plug 104 is comprised of a cylindrical bore 106 and an O-ring groove 107 at the end. An O-ring 108 is installed on the O-ring groove 107 to maintain the gas pressure inside the reservoir for better deployment performance.

Figure 8C:
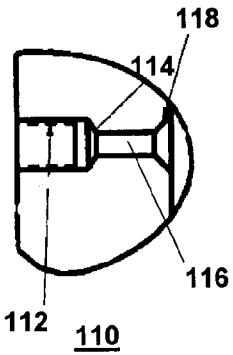

With further reference to FIG. 8B, a small meter orifice 110 is formed in and positioned at the center of the circular end plate 100. With reference to FIG. 8C, the meter orifice 110 is comprised of a threaded hole 112, a small circular aperture 114, a thin cylindrical orifice 116, and a conical opening 118 into the cylindrical bore 106 of the cylindrical plug 104. Inside feature 112 is installed an orifice which determines amount of bleed pressure into the reservoir. The insert orifice is made from a copper tungsten material. This material does not erode as high velocity gas passes though the orifice.

With further reference to FIG. 8A, a plurality of bolt holes 120 are machined into the exterior of the circular end plate 100. FIG. 8A illustrates two such bolt holes 120 disposed diametrically opposite to each other. A plurality of break screws 122 are designed to be inserted into the bolt holes 120 and then threaded into the threaded holes 57 of the back assembly 26. The break screws 122 are designed to hold the cover assembly onto the boomtail during handling as well as to provide initial squeeze of the o-ring between the cover and the back plate. The break screws then fail at the muzzle exit due to the force within the cover pressure reservoir to release the cover assembly 28 from the back assembly 26 for fin deployment.

Figure 9A:
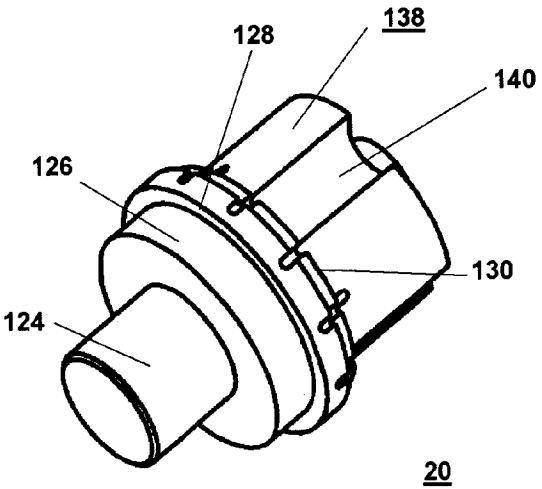
FIG. 9 illustrates various orthogonal and perspective views of the cant-boomtail of FIG. 2.
Figure 9B:
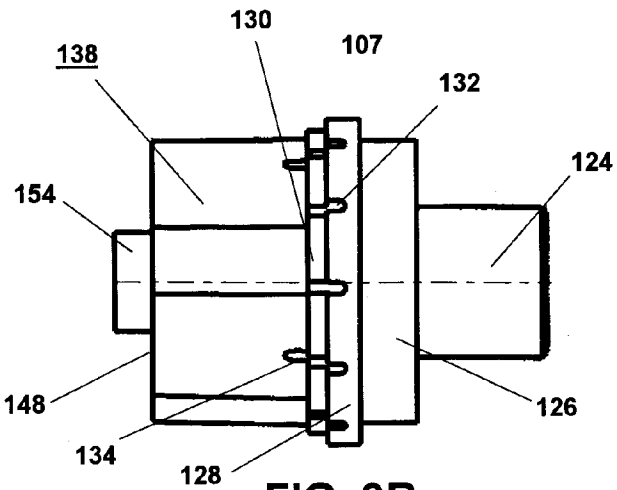

Referring now to FIG. 9A, the cant-boomtail 20 is the main structural component of the space-saving fin deployment system 12. The cant-boomtail 20 is a structure of circular symmetry comprising of a number of features as follows: With further reference to FIGS. 9A–B, a cylindrical plug 124 is formed at one distal end of the cant-boomtail 20 and is designed to provide a means of engaging the space-saving fin deployment system 12 into the projectile body 14. A circular landing area 126 is formed integrally at the base of the cylindrical plug 124 and extends to an adjoining circular indexing step portion 128.

The circular indexing step portion 128 then adjoins a smaller circular indexing step portion 130 having a slightly smaller width and radius. Referring to FIGS. 9A–B, a plurality of indexing grooves 132 and 134 are formed at equidistance around the periphery of the circular indexing step portion 128. With specific reference to FIG. 9C, the indexing grooves 132 are generally curved passages extending from the peripheral surface of the circular indexing portion 128 to the bottom surface 136 of the smaller circular step portion 130. With further reference to FIG. 9B, the indexing grooves 134 are also formed of curved channels starting from the peripheral surface of the circular step portion 128 and terminating on a surface of a hinge pocket structure 138. The purpose of feature 132 is to provide gas release from under the fin blades to outside the fin cover, this intern helps slow down deployment speed of the fin system.

Referring to FIG. 9A, the hinge pocket structure 138 is generally located in the aft section of the cant-boomtail 20 and integrally adjoins with the smaller circular indexing step portion 130. The hinge pocket structure 138 is comprised of a plurality of hinge pockets 140 formed lengthwise along the hinge pocket structure 138. In FIG. 9A, four such hinge pockets 140 are illustrated. The hinge pockets 140 are generally machined surfaces having nearly semicircular cavities recessed inward from the outer surface 142 of the hinge pocket structure 138. The shape of the hinge pockets 140 is designed so as to provide a near zero-clearance fit with the hinge assembly 26 in order to maximize space savings. With specific reference to FIG. 9D, the outer surface 142 of the hinge pocket structure 138 is geometrically constructed by a plurality of eccentric circular arc segments interposed the hinge pockets 140. Boomtail surface 138 has a specific contour to it for system function. The surface provides a constant curvature for the fin to rest upon, when the fin is wrapped it goes over the next adjacent hinge. The surface ramps the fin up to the hinge and allows for the fin to transition unto the hinge without any harsh transitions.

Figure 9C:
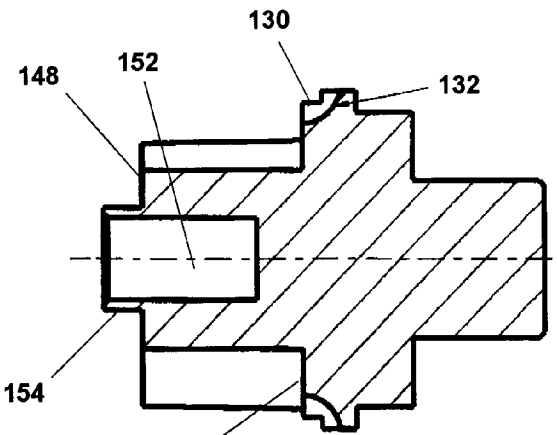
Figure 9D:
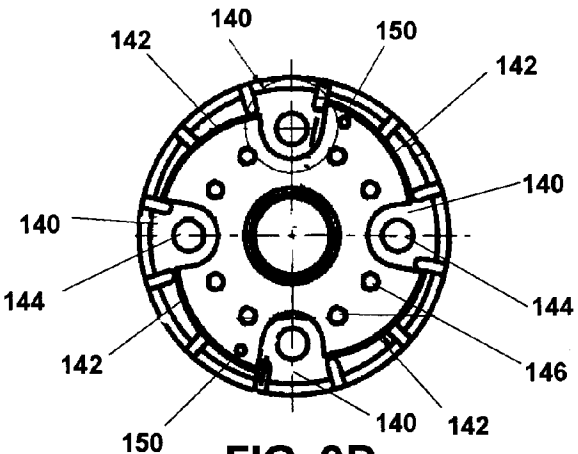

With further reference to FIG. 9D, a plurality of cylindrical bores 144 are machined at a partial depth through the bottom surface 136 of the smaller circular indexing step portion 130 within each hinge pocket 140. There are four such cylindrical bores 144 as illustrated in FIG. 9D. These cylindrical bores 144 are designed to enable the cant hinges 64 to be positively retained within the hinge pockets 140 by engaging the large end plugs 74 therein. Further, a plurality of pairs of smaller threaded bolt holes 146 are machined into the distal end surface 148 of the hinge pocket structure 138. In a preferred embodiment, four such pairs of threaded bolt holes 146 are employed as shown in FIG. 9D. These pairs of threaded bolt holes 146 are designed to enable a bolted joint connection between the back assembly 26 and the cant boomtail 20 via the retaining bolts 32.

With further reference to FIG. 9D, two diametrically opposed alignment holes 150 are formed on the distal end surface 148 and are located near the periphery of the hinge pocket structure 138. These alignment holes 150 enable a precise positioning of the boomtail 20 with respect to the back assembly 26 via the alignment pins 40. With reference to FIG. 9C, a large cylindrical bore 152 is integrally formed within the hinge pocket structure 138 at a substantial depth from the distal end surface 148. The cylindrical bore 152 extends beyond the distal end surface 148 to form a small hollow cylindrical plug 154.

Referring now to FIG. 2 again, the assembly sequence of the space-saving fin deployment system 12 is as follows: The obturator assembly 18 is shaped as a circular ring with an outer diameter nominally equal to that of the circular indexing portion 128 and an inner diameter nominally equal to that of the circular landing area 126. The width of the obturator assembly 18 is also nominally equal to that of the circular landing area 126. The obturator assembly 18 is slipped onto the circular landing area 126 abutted against the circular indexing portion 128 of the cant boomtail 20 to form a flush, tight tolerance fit.

With reference to FIG. 5, the fins 58 are slip fitted into the grooves 82 of the cant hinges 64. Upon aligning the bolt holes 62 of the fins 22 with the threaded bolt holes 84 of the cant hinges 64, retaining bolts 66 are torqued to secure the fin system 22 to the hinge assembly 24. The compression springs 70 are fitted onto the cylindrical aft section 94 of the lock pins 68, which are then inserted into the cylindrical bores 72 of the cant hinges 64.

The hinge assembly 24 is now engaged with the cant boomtail 20 on one end by means of insertion of the larger end plugs 74 of the cant hinges 64 into the cylindrical bores 144 of the cant boomtail 20. On the other end, the hinge assembly 24 is engaged with the back assembly 26 by means of insertion of the smaller end plugs 76 into the cylindrical bores 54 of the cant back plate 30. The hinge assembly 24 is free to pivot while being axially restrained by the cant boomtail 20 and the back assembly 26.

The back assembly 26 is then secured to the cant boomtail 20 via the retaining bolts 32 inserted through the pairs of bolt holes 46 of the cant back plate 30 and threaded into the corresponding pairs of threaded bolt holes 146 of the hinge pocket structure 138. FIG. 10A illustrates the combined assembly of the cant boomtail 20, the fin system 22, the hinge assembly 24, and the back assembly 26.

Figure 10B:
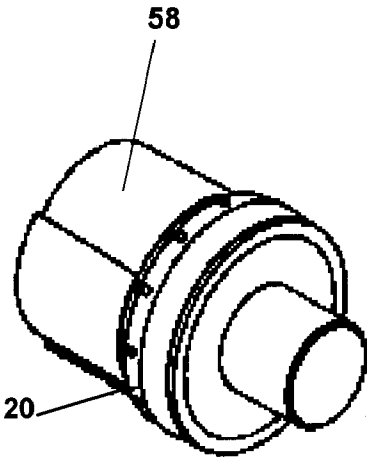
FIG. 10 is a perspective view of the space-saving fin deployment system of FIG. 3, shown with the cover and fins in the stowed position as viewed when the projectile is loaded into the cartridge.
Figure 10D:
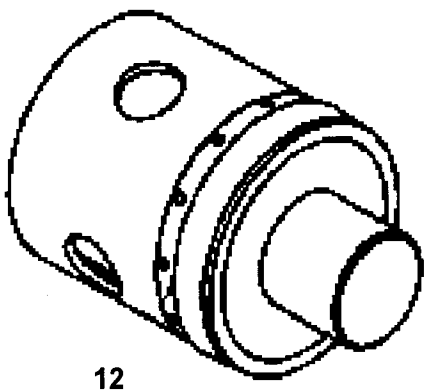
Figure 10A:
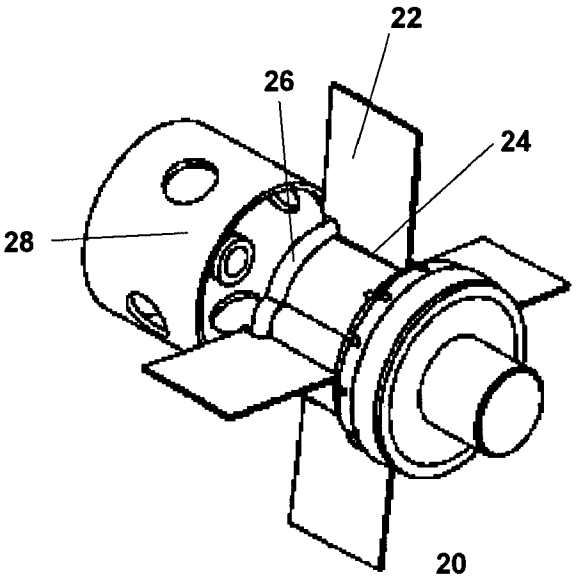
Figure 10C:
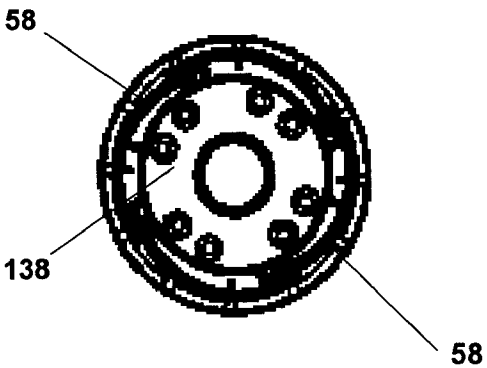

With reference to FIG. 10B, the hinge assembly 24 is rotated while the fins 58 are simultaneously curved into circular arcs to wrap around the hinge pocket structure 138 as illustrated in FIG. 10C. The cover assembly 28 is then slipped onto the wrap-around fins 58 and abutted against the circular indexing step portion 128. The break screws 122 are then inserted through the bolt holes 120 of the cover assembly 28 and threaded to into the threaded bolt holes 57 of the cant back plate 30 to secure the cover assembly 28 to the back assembly 26. The space-saving fin deployment system 12 is now completed as illustrated in FIG. 10D and is ready to be assembled to the projectile body 14 via the cylindrical plug 124 of the cant boomtail 20 as shown in FIG. 1.

The functionality of the present invention may be appreciated by considering the following deployment sequence:

Upon exiting the muzzle of the gun tube, the base pressure on the munitions system 10 begins to decrease. The gas pressure inside the pressure reservoir of the cover assembly 28 and the cant boomtail 20 is maintained. The resulting differential pressure exerts a force onto the circular end plate

100 inside the pressure reservoir. As base pressure drops from behind the projectile the pressure within the reservoir deploys the cover from the fin system releasing the fin system. The cover retention screws 122 are broken as the cover ejects. The cover retention screws are designed as a low tensile strength material. The cover retention screws do not provide the strength required keeping the cover on the projectile during launch; rather that is the job of the base pressure inside the gun tube. The cover retention screws provide a mechanical means to squeeze the o-ring between the cover and cant back plate. The stored energy in the wrapped fin is all that is needed to rotate the hinge assembly and deploy the fin.

Upon exposure, the fins 58 begin to unwrap themselves from the cant boomtail 20. The unwrapping of the fins 58 also inputs into the hinge assembly 24 a torque. This torque causes the cant hinges 64 to rotate 107 degrees from a closed position to a lock position whereupon the spring loaded lock pins 68 are propelled forward into the lock pin holes 59 of the cant back plate 30. Upon locking, due to the super elasticity of the fin material, the fins 58 are now straightened themselves into zero-curvature surfaces. The space-saving fin system 12 is now in a fully deployed state for mission readiness.

It should be understood that the geometry, compositions, and dimensions of the elements described herein can be modified within the scope of the invention and are not intended to be the exclusive; rather, they can be modified within the scope of the invention. Other modifications can be made when implementing the invention for a particular environment.

What is claimed is:

1. A fin deployment system for attachment to a projectile having a main axis, comprising:

a plurality of fins;

a plurality of hinges attached to an aft section of the projectile to rotate the fins from a stowed position to a deployed position after the projectile is launched;

a retention cover attached to the aft section of the projectile to cover and retain the fins while the projectile is in storage and before the projectile is launched, further comprising a fin cover that provides retention of the fins while in the stowed position, and wherein the fin cover comprises a pressure reservoir that uses a propellant gas to deploy after the projectile is launched to release the fins into the deployed position; and wherein the fin cover further comprises a plurality of pressure equalization holes disposed radially, peripherally, externally, relative to the fin cover, to provide pressure mitigation for the fin cover, to permit the fin cover to selectively deploy after launch; and, wherein the fins wrap around the aft section prior to deployment and deploy radially relative to the projectile main axis.

2. The system of claim 1, wherein during launch, the propellant gas generates a net pressure force that maintains the fin cover in contact with the aft section.

3. A fin deployment system for attachment to a projectile having a main axis, comprising:

a plurality fins:

a plurality of hinges attached to an aft section of the projectile to rotate the fins from a stowed position to a deployed position after the projectile is launched; and, wherein the aft section includes an outside profile that provides a wrapping surface for the plurality of fins;

wherein the plurality of fins include a plurality of fin blades; and wherein the aft section comprises pressure release slots disposed radially around the aft section, to provide pressure release from the fins for deployment of the fins, in order to mitigate a deployment velocity of the fins, and wherein the wrapping surface further provides a support for the fin blades when the fins are in a stowed position; and, a retention cover attached to the aft section of the projectile to cover and retain the fins while the projectile is in storage and before the projectile is launched;

wherein the fins wrap around the aft section prior to deployment, and deploy radially relative to the projectile main axis.

* * * * *